US005791979A

United States Patent [19]

Duncan et al.

[11] Patent Number: 5,791,979

[45] Date of Patent: Aug. 11, 1998

[54] GRINDING VACUUM SHROUD

[76] Inventors: C. Warren Duncan, 1281 Logan Ave., Suite F, Costa Mesa, Calif. 92626; William D. Glynn, 521 Babbs Rd., West Suffield, Conn. 06093

[21] Appl. No.: 818,348

[22] Filed: Mar. 17, 1997

[51] Int. Cl.[6] ..... B24B 23/02

[52] U.S. Cl. ..... 451/456; 451/359

[58] Field of Search ..... 451/451, 456, 451/457, 359

[56] References Cited

U.S. PATENT DOCUMENTS

| | | | |
|---|---|---|---|
| 3,256,648 | 6/1966 | Subonovich | 451/456 |
| 4,462,381 | 7/1984 | Fushiya et al. . | |
| 4,622,782 | 11/1986 | Roestenberg | 451/456 |
| 4,860,400 | 8/1989 | Urakami | 451/456 |
| 5,125,190 | 6/1992 | Buser et al. . | |
| 5,477,844 | 12/1995 | Meister | 451/456 |
| 5,580,302 | 12/1996 | Howard, Jr. et al. | 451/456 |
| 5,609,516 | 3/1997 | Courson et al. | 451/456 |

*Primary Examiner*—Eileen P. Morgan
*Attorney, Agent, or Firm*—Charles H. Thomas

[57] ABSTRACT

An improved vacuum shroud is provided for a grinding tool. The vacuum shroud employs a resilient bonnet with a central, axial opening therein for receiving a rotary grinder shaft therethrough. The bonnet is formed of a resilient, flexible, plastic material having a roof with a skirt at the periphery of the roof that laterally surrounds the grinder disk. A reinforcement plate at the undersurface of the roof protects the roof of the vacuum shroud when the grinder body is tilted at an incline toward a work surface so as to exert a greater pressure on one portion of the grinding face of the grinding disk than another. The peripheral region of the roof of the bonnet is flexible enough to permit orientation of the grinder tool body at various angles of inclination relative to the work surface while still maintaining contact between the work surface and the lower edge of the bonnet skirt throughout its entire length. The improved vacuum shroud thereby maintains substantially complete contact between the skirt of the vacuum shroud bonnet and the work surface regardless of the angle of orientation of the grinder tool body relative to the work surface. This aids in confining airborne particles within the plenum located beneath the vacuum shroud and above the work surface, while at the same time preserving a high degree of suction within the plenum.

15 Claims, 5 Drawing Sheets

GRINDING VACUUM SHROUD

BACKGROUND OF THE INVENTION

1. Field of the Invention

The present invention relates to an improved vacuum shroud adapted for use with a grinding tool to more effectively prevent the dispersal of particulate matter produced by the grinding tool.

2. Description of the Prior Art

For many years power grinding tools have been utilized to finish both flat and curved surfaces. Such tools are often hand-held devices powered by electric motors, although hydraulically and pneumatically powered grinders are sometimes utilized in particular applications. The power source, typically an electric motor, is normally housed within a grinder body or casing from which a rotary drive shaft protrudes. A grinding disk, typically having a flat circular or annular surface covered with some grinding compound, such as sand or grit, is attached to the rotary drive shaft. One or more handles on the grinder body allow a user to manipulate the grinding tool so as to smooth a work surface to be finished.

To be effective the grinding disk must be operated at a high speed, typically on the order of about 1750 revolutions per minute. At this speed a considerable amount or particulate matter, such as dust and debris ground from the work surface, is thrown into the air in the vicinity of the grinding disk. Unless some form of collection system is employed, the particulate matter generated will fill the air in the immediate vicinity of operation of the grinding tool. This is unhealthful to the workman operating the tool, as well as to others in the immediate vicinity. Also, airborne dust, debris, and grit invariably collect on objects and articles in the vicinity. As a result, these settled pollutants must be removed.

To prevent the dispersal of airborne particulate matter, grinding tools are often provided with a vacuum-operated dust collection system. According to conventional practice a concave, confining shroud or hood is secured to the grinding tool body in overlying and surrounding relationship relative to the grinding disk. Also, such conventional hoods are provided with vacuum ports and vacuum hose connections through which airborne particulate matter confined within the shroud or hood is drawn by suction and collected for disposal.

While the theory of collecting airborne particulate matter produced by operation of a grinding tool using a vacuum collection system is sound, in practice conventional systems of this type have been rather inefficient. One principal reason for this inefficiency is that in operating a grinder the face of the grinding disk is only rarely disposed flat against the work surface. Far more frequently the circular or annular grinding face of the grinding disk is oriented at a slight angle relative to the work surface. As a result, the body of the grinding tool is tilted slightly relative to the work surface. If the hood or shroud employed is a rigid structure, the tilting of the grinding tool body necessarily requires at least a portion of the vacuum shroud skirt to be lifted from the work surface during grinding. As a consequence, a considerable amount of the airborne particulate matter is thrown outwardly beneath the lifted portion of the skirt due to the centrifugal force imparted by rotation of the grinding disk. Conventional vacuum shrouds thereby fail to confine and thus allow vacuum collection of a very substantial portion of the airborne particulate matter produced during grinding.

To attempt to remedy this defect some vacuum shrouds have been devised which are generally bowl-shaped structures and are formed entirely of a resilient, flexible plastic. Utilizing such a device the annular rim of the shroud can maintain contact with the work surface even if the grinding disk and grinder body of the tool are tilted relative to the work surface. This is possible because the structure of the vacuum shroud will flex near the rapidly rotating shaft driving the grinding disk where the shroud is normally connected to the grinder body. However, this system is defective since the raised edge of the grinding disk invariably slices through the soft structure of the roof of the vacuum shroud when the grinding disk is tilted relative thereto. As a consequence, conventional, resilient, flexible, plastic vacuum shrouds have a very limited useful life.

Still a further approach which has been attempted is to form the vacuum shroud as a relatively rigid plate having at it is peripheral edge a ring of bristles that extend so parallel to the axis of rotation of the rotary shaft that turns the grinding disk. In this system the bristles forming the skirt can be compressed at the edge of the shroud that is tilted downwardly, thus allowing the bristles at the opposite edge to maintain contact with the work surface. However, conventional systems employing a shroud having a skirt formed of bristles are largely ineffective, since the bristles prevent the formation of an adequate vacuum in the plenum within the shroud. As a consequence, the vacuum suction applied using such conventional systems is insufficient to collect a significant portion of airborne particulate matter.

SUMMARY OF THE INVENTION

The present invention is an improved vacuum shroud for a grinding tool that remedies the deficiencies of prior art devices provided for the same purpose. Specifically, the vacuum shroud of the present invention employs a concave bonnet or hood having a laterally expansive roof with a skirt depending therefrom that maintains good vacuum suction within a plenum surrounding the grinding disk, and which is not damaged by tilting of the grinding disk relative to the work surface.

The vacuum shroud of the invention is unique in that it employs a bonnet or hood having a peripheral skirt that not only is able to make contact with the work surface despite tilting of the grinding disk relative thereto, but which also maintains the vacuum within the plenum to a considerable degree despite such tilting.

The vacuum shroud for a grinding tool according to the invention has an additional advantage in that it is constructed so that tilting of the rotating grinding disk relative to the work surface does not bring the raised edge of the grinding disk into contact with a soft plastic roof forming the top part of the shroud. Rather, the system is devised so that the roof of the shroud will flex inwardly toward the work surface near its peripheral margin overlying the portion of the grinding disk tilted toward the work surface, and outwardly from the work surface over the diametrically opposed portion of the grinding disk that must necessarily be raised. This flexing of the roof is accomplished while maintaining the edge or rim of the vacuum shroud skirt in contact with the work surface throughout its circumference.

In one broad aspect the present invention may be considered to be a vacuum shroud for a grinding tool having a grinder body, a rotary drive shaft protruding from the grinder body and a grinding disk attached to the grinder body. The vacuum shroud of the invention is comprised of a concave hood formed with a laterally extending roof having a central axial opening therethrough for receiving the rotary drive shaft and a skirt extending from the periphery of the roof and disposed about the grinding disk beyond the perimeter thereof. According to the improvement of the invention, the skirt is stiffened throughout and the roof is reinforced above the grinding disk. The periphery of the roof is resilient and flexible.

Preferably the roof and the skirt are formed as a unitary, resiliently flexible, plastic bonnet and the hood is further comprised of a rigid plate secured to the underside of the roof in overlying relationship to the grinding disk. The plate thereby provides protection to the portion of the roof above the grinding disk. Also, a rigid band is secured to the skirt of the bonnet to thereby stiffen the skirt.

In most embodiments of the invention the skirt has an annular shape and the rigid band is formed as a reinforcing metal ring encapsulated within the structure of the skirt. For some applications, however, it is necessary for a portion of the grinder to be exposed so that the grinder disk can be moved up against abutting surfaces, such as walls or other surfaces oriented perpendicular to the work surface. In such a case the bonnet may be formed with a concave undersurface from a flexible and resilient molded plastic structure which has an otherwise bowl-shaped configuration with a segmental portion removed therefrom. For example, the removed segment may be formed by a cord extending across an arc of about fifty degrees. In this embodiment the rigid band has an arcuate configuration extending throughout the one hundred thirty degree arc of the skirt and is preferably encapsulated within the structure of the skirt.

In another broad aspect the invention may be considered to be a vacuum shroud for a grinder comprising a resilient bonnet formed with a central, axial opening therein for receiving a rotary grinder shaft therethrough, wherein the bonnet is formed with a roof having an undersurface and which has a vacuum port therein. The roof extends radially from the central, axial opening. A peripheral skirt is provided that extends from the roof toward a work surface radially beyond a grinder disk attached to the rotary shaft. A rigid, reinforcement plate is disposed against the undersurface of the roof to thereby provide protection to the roof above the grinder disk. A peripheral reinforcement strip is secured to the skirt to limit flexure thereof.

In still another broad aspect the invention may be considered to be an improvement in a grinding tool having a grinder body, a rotary drive shaft protruding from the grinder body, a grinding disk attached to the rotary drive shaft, and a vacuum shroud. The vacuum shroud includes a concave bonnet disposed about the rotary drive shaft and the grinding disk. The bonnet has a roof with a vacuum port defined therethrough and is secured relative to the grinder body. The roof extends radially outwardly relative to the rotary drive shaft past the perimeter of the grinding disk in overlying relationship relative to the grinding disk. The bonnet has a skirt extending from the periphery of the roof in a disposition about the grinding disk beyond the perimeter thereof. According to the improvement of the invention, the skirt of the bonnet is stiffened and the interior portion of the roof overlying the grinding disk is reinforced. The roof of the bonnet also has a resilient and flexible peripheral portion.

The invention may be described with greater clarity and particularity by reference to the accompanying drawings.

DESCRIPTION OF THE EMBODIMENT

Figure 1:
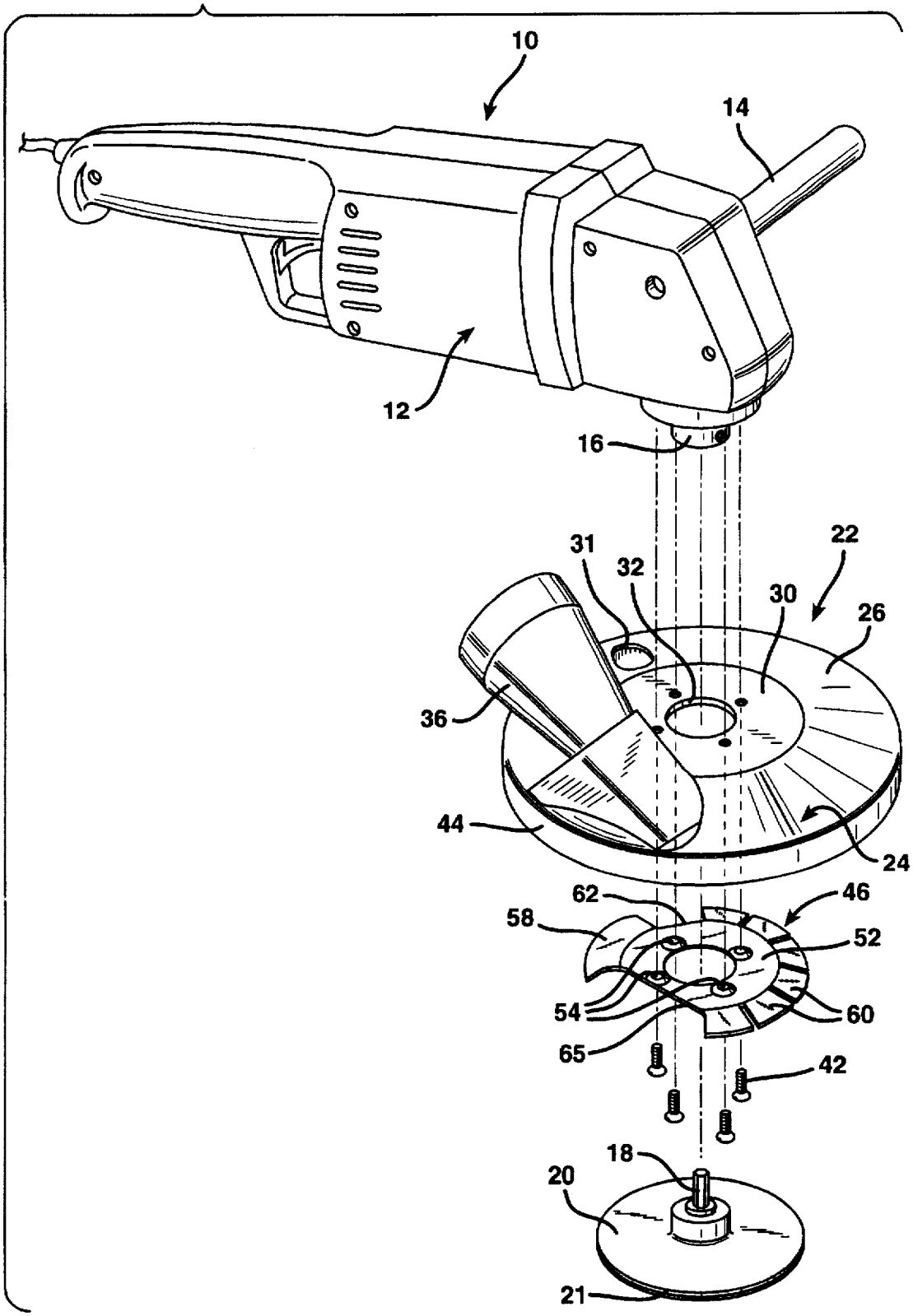
FIG. 1 is an exploded perspective view of one preferred embodiment of an improved grinding tool according to the present invention.

FIG. 1 illustrates an electrically powered, hand held, grinding tool 10 having a grinder body 12 from which a handgrip 14 extends. The grinding tool 10 also has a chuck 16 to which a rotary drive shaft 18 is secured in a conventional manner. When assembled, the drive shaft 18 protrudes from the grinder body 12 and has a grinding disk 20 attached thereto.

The grinding tool 10 also has a vacuum shroud 22 constructed according to the present invention. The vacuum shroud 22 includes a generally bowl-shaped or dish-shaped, concave bonnet 24 formed from a flexible and resilient molded plastic structure indicated at 26. The structure 26 may be formed by polyvinyl chloride plastic, for example. The structure 26 has a concave undersurface 28 facing the grinding disk 20.

The bonnet 24 has a roof 30 with a central, axial opening 32 defined therein. The opening 32 receives the chuck 16 and the rotary grinder shaft 18 therethrough. The roof 30 also has a vacuum port 34 defined therethrough to which a vacuum duct 36 is connected. The vacuum duct 36 is connected to a hose assembly, indicated in phantom at 38 in FIGS. 2 and 4, that leads to a vacuum collection receptacle. Suction is exerted in a conventional manner by means of a conventional vacuum apparatus so as to draw air and particulate matter through the vacuum port 34 and into the collection receptacle (not shown).

The roof 30 of the bonnet 24 is secured to the grinder body 12 by means of machine screws 42. The roof 30 extends radially outwardly relative to the rotary drive shaft 18 and past the outer perimeter of the grinding disk 20 and resides in overlying relationship relative thereto. The bonnet 24 also has an annular skirt 44 extending from the periphery of the roof 30 in a disposition about the grinding disk 20 radially beyond the perimeter 21 thereof. The skirt 44 is reinforced by means of a spring steel band 70 formed into a reinforcement metal ring or hoop and encapsulated within the structure of the annular skirt 44.

According to the improvement of the invention the skirt 44 of the bonnet 22 is stiffened and the interior portion of the roof 30 overlying the grinding disk 20 is reinforced. Specifically, in the embodiment illustrated, the central, interior portion of the roof 30 that overlies the grinding disk 20 is reinforced by means of a rigid reinforcement plate 46 that resides in contact with the undersurface 28 of the resilient, bowl-shaped member 26. The roof 30 of the bonnet 22 has a resilient and flexible peripheral portion indicated at 50 which is located at the periphery of the portion of the roof 30 that is reinforced by the reinforcement plate 46.

The rigid reinforcement plate 46 is stamped from a sheet of aluminum about one-sixteenth of an inch in thickness and is formed in an annular configuration. The reinforcement plate 46 has a flat, generally annular, interior portion 52 perforated by four countersunken openings 54 that are located at ninety degree intervals relative to each other. A plurality of flanges 58 and 60 extend radially outwardly from the flat interior region 52. The interior portion 52 of the reinforcement plate 46 is secured tightly relative to the grinding tool body 12 by means of the machine screws 42 that are engaged in corresponding internally-tapped bolt holes in the grinder body 12. The machine screws 42 thereby hold the reinforcement plate 56 and the interior portion of the roof 30 of the bonnet 22 tightly against the grinder body 12.

The reinforcement plate 46 has a central opening 56 through its interior portion 52 that is coaxial with the central, axial opening 32 in the bonnet roof 30. The reinforcement plate 46 also has a plurality of flanges 58 and 60 that extend radially from the flat interior portion 52. A gap 62 is defined between one of the flanges 60 and the flange 58 so as not to block an air inlet port 31 that extends through the roof 30. On its opposite side the reinforcement plate 46 is provided with an even larger cutout 65 between another of the flanges 60 and the flange 58 so as not to obstruct the vacuum port 34. The air inlet port 31 is located in annular displacement from the vacuum port 34 and is provided so as to allow a flow of air into the plenum enclosure 27 beneath the bonnet 22 as indicated by the directional arrow 64 in FIG. 2. This flow of air in necessary to entrain the particulate matter indicated at 39 so that it may be transported to the vacuum collection receptacle (not shown). Without the air inlet port 31, the vacuum exerted in the plenum enclosure 27 beneath the concave undersurface 30 of the bonnet 22 would act to draw the bonnet 22 too tightly against the work surface 66, and thereby inhibit both rotation and lateral movement of the grinding disk 20.

Figure 2:
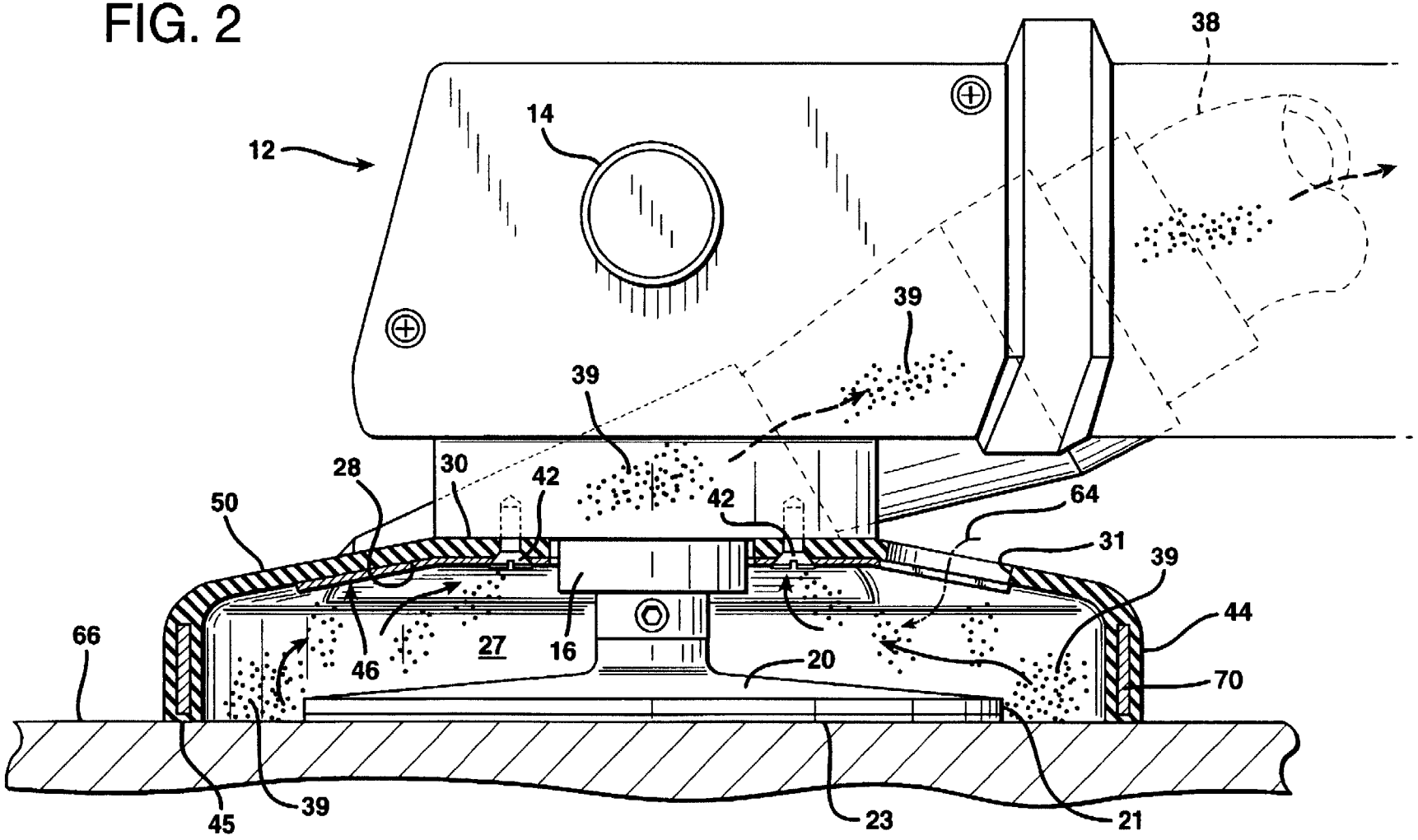
FIG. 2 is a sectional elevational view illustrating use of the grinding tool of FIG. 1 with the grinding disk flat against the work surface.
Figure 3:
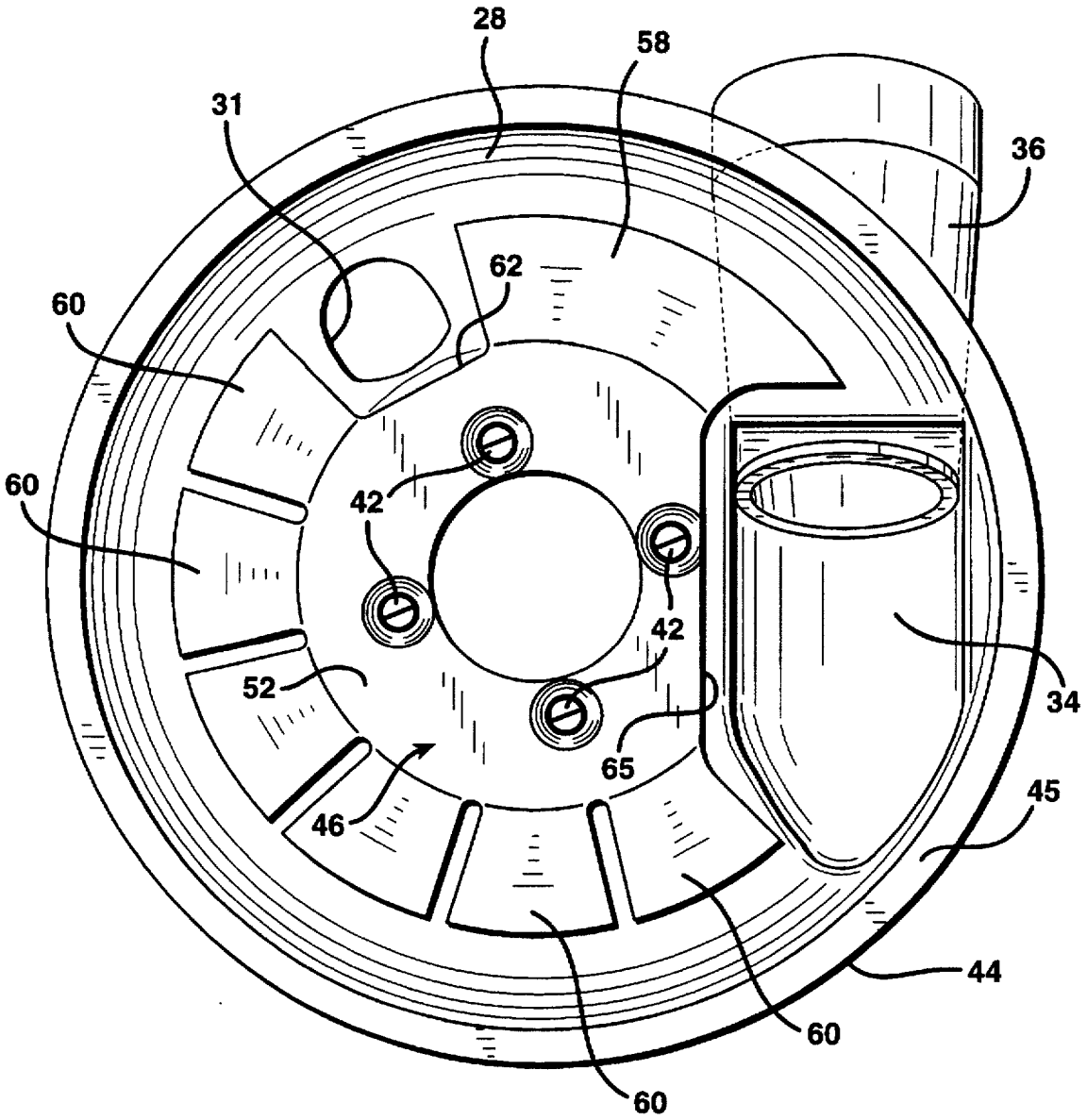
FIG. 3 is a bottom plan view of the vacuum shroud of the embodiment of FIG. 2, shown in isolation from the grinding tool thereof.

As illustrated in FIG. 2, the grinding tool 10 may be operated in a manner such that the grinding disk 20 rotates flat against the work surface 66 so that its grinding face 23 contacts the work surface 66 throughout. In this disposition the rotary drive shaft 18 is oriented perpendicular to the work surface 66, and the pressure of the skirt 44 against the work surface 66 is uniform throughout the circumference of the annular rim 45 of the skirt 44. The skirt rim 45 thereby resides in contact with the work surface 66 throughout its entire circumference. As a consequence, the airborne particulate matter 39 that is produced from the grinding operation is confined within the plenum or enclosure 27 defined beneath the bonnet 24 and above the work surface 66. This prevents the particulate matter 39 from being thrown centrifugally outwardly by the high speed of rotation of the grinding disk 20, and also ensures that a strong suction exists within the plenum 27. However, in actual practice the grinding tool 10 is operated in the orientation depicted in FIG. 2 only relatively infrequently.

Figure 4:
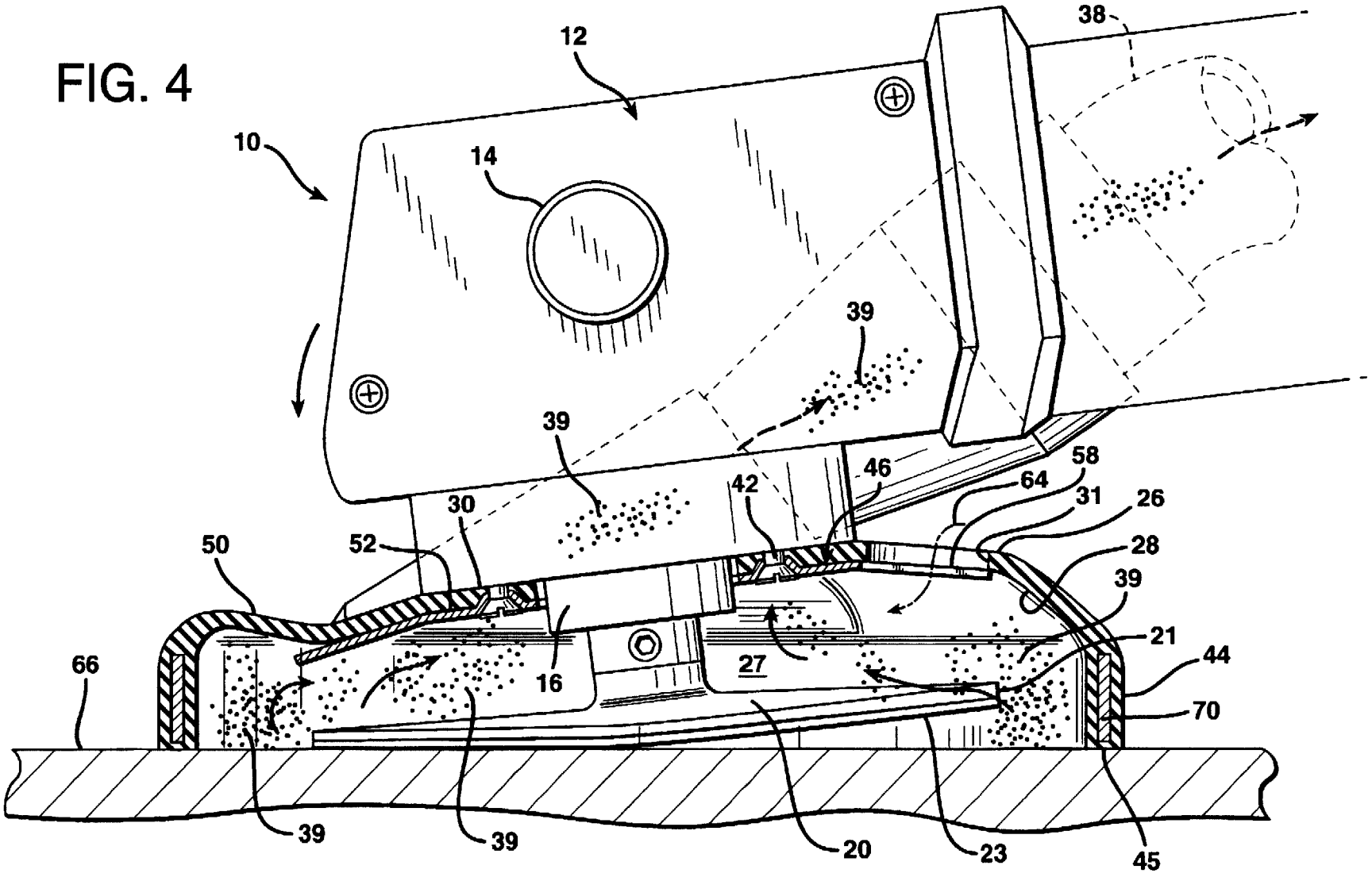
FIG. 4 is a sectional elevational view illustrating operation of the grinding tool of FIG. 2 with the grinding disk tilted relative to the work surface.

Much more typically, the grinding tool 10 is operated in the disposition depicted in FIG. 4. In this orientation the body 12 of the grinding tool 10 is inclined slightly relative to the work surface 66 so as to impart a greater grinding force on the portion of the grinding face 23 of the grinding disk 20 remote from the operator. As a result, the portion of the grinding face 23 of the grinding disk 20 nearest the operator is lifted from the work surface 66.

With conventional vacuum shrouds operation of the grinding tool 10 in this manner would result in the portion of the skirt 44 nearest the operator to lift up from the work surface 66. As a consequence, a considerable amount of the airborne particulate 39 would be thrown laterally outwardly and escape between the work surface contact rim 45 of the skirt 44 and the work surface 66. Moreover, a considerable portion of the suction power in the plenum 27 would be lost.

By utilizing the vacuum shroud 22 of the present invention, however, this does not occur. As illustrated by FIG. 4, when the grinder body 12 is operated at a slight incline relative to the work surface 66, the peripheral region 50 of the roof 30 remote from the tool operator at and beyond the periphery of the reinforcement plate 46 is able to flex downwardly and lift slightly away from the upper surface of the reinforcement plate 46. As a consequence, although the grinding disk 20 is tilted relative to the work surface 66, there is no force acting on the portion of the skirt 44 closest to the grinding tool operator tending to lift that portion of the contact rim 45 from the work surface 66.

Quite to the contrary, the contact rim 45 of the skirt 44 remains in contact with the work surface 66 throughout its entire circumference. As a result, even the particulate matter 39 that is thrown toward the region of the skirt 44 closest to the grinding tool operator is still entrapped within the plenum 27. As a consequence, it cannot escape except through the vacuum port 34. Moreover, the suction applied through the vacuum duct 36 is not diminished due to any discontinuity of contact between the annular edge 45 of the bonnet skirt 44 and the work surface 66. Thus, the vacuum shroud 22 depicted in FIGS. 1–4 is able to operate in a much more efficient manner than conventional vacuum shrouds when the grinding tool 10 is held at an angle at which it is most typically operated in actual practice.

In the vacuum shroud 22 the bonnet 24 is formed by a flexible and resilient, molded plastic, bowl-shaped member 26 having a concave undersurface 28 facing the grinding disk 20, and the skirt 44 extends throughout the entire circumference of the roof 30. However, as is evident in FIGS. 2 and 4, should the grinding tool 10 be operated in an area where an upright abutment rises from the work surface 66, the necessary radial separation between the skirt 44 and the outer perimeter edge 21 of the grinding disk 20 would leave a marginal region adjacent the obstruction that could not be finished by the grinding surface 23 of the grinding disk 20.

Figure 5:
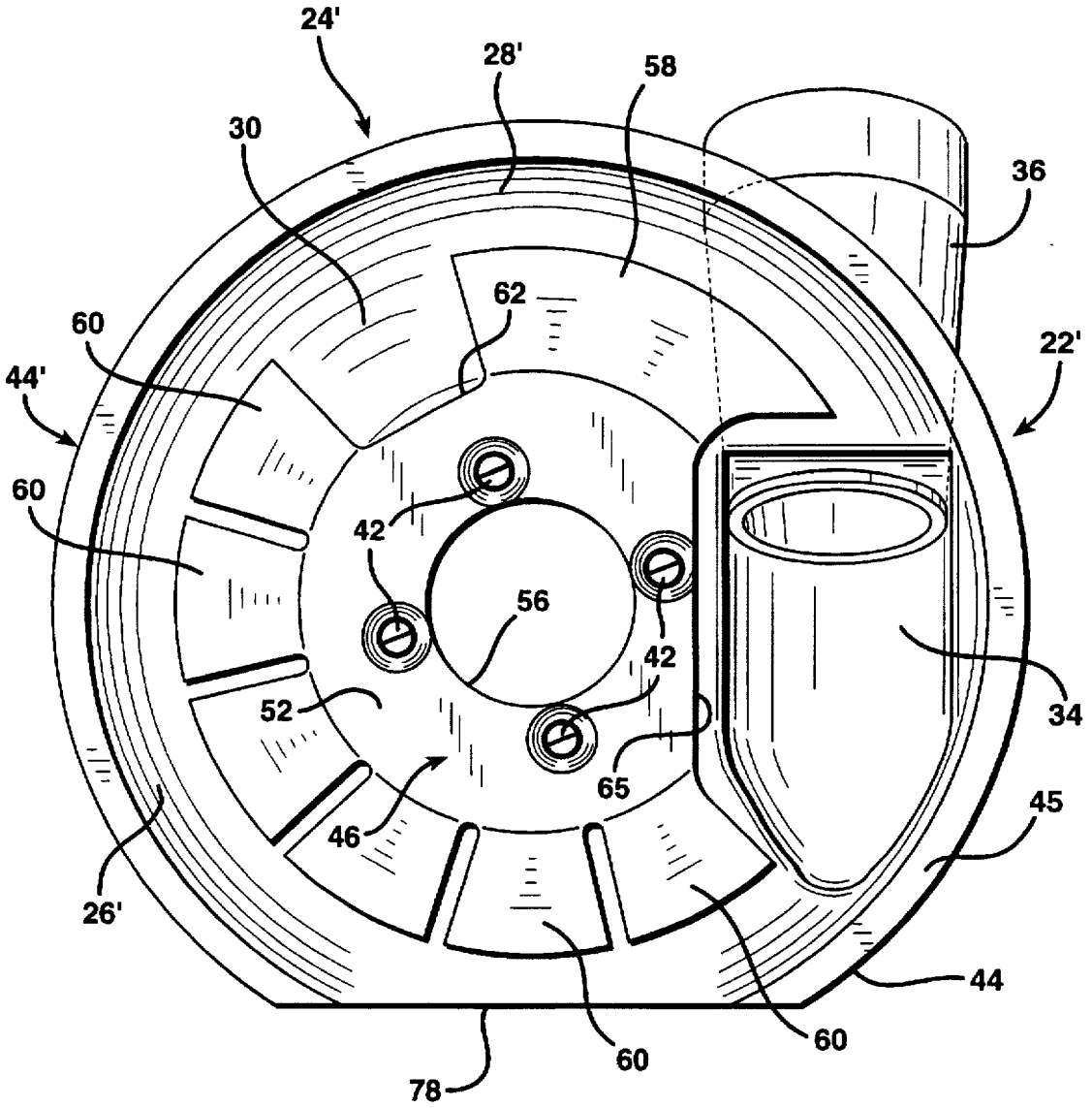
FIG. 5 illustrates an alternative embodiment of a vacuum shroud according to the invention to that depicted in FIG. 3.

In such situations, a modified form of a vacuum shroud constructed according to the invention may be employed. FIG. 5 illustrates a vacuum shroud 22' similar in may respects to the vacuum shroud 22, but differing from that embodiment in several respects. Specifically, the bonnet 24' of the vacuum shroud 22' is formed from a resilient, flexible, otherwise bowl-shaped, molded plastic structure 26' from which a segment beyond a linear cord 78 has been removed. The bonnet 24' is formed with a concave undersurface 28' from which a segmental portion extending over an arc of about fifty degrees removed beyond the segmental cord 78.

In the vacuum shroud 22' the same rigid reinforcement plate 46 is disposed in contact with the concave undersurface 28' against the interior portion of the roof 30 thereof. The same rigid band 70 is encapsulated within the structure of the skirt 44'. However, since a segmental portion of the skirt 44' is removed, this metal band does not form a complete ring, but rather is a discontinuous structure that extends over the arc of three hundred ten degrees which the skirt 44' occupies.

While there is some loss of suction force using the vacuum shroud 22', this loss of vacuum power may be alleviated somewhat, since no inlet opening 31 is required in the roof 30. Rather, air is drawn in through the gap in the skirt 44' created at the cord 78 extending across the forward edge of the bonnet 22'. Moreover, since there is a gap in the skirt 44', the perimeter edge 21 of the grinding disk 20 can be moved right up into abutment against any vertical obstruction, thus allowing the entire work surface 66 to be finished.

Undoubtedly, numerous other variations and modifications of the invention will become readily apparent to those familiar with grinding tools. For example, a separate reinforcement plate 46 need not necessarily be employed. Rather, the necessary reinforcement of the interior portion of the roof could be provided by constructing that portion of the roof of the bonnet of a different material or with an increased thickness. The depending skirt at the periphery of the roof could likewise be formed of a different, stiffer or more rigid material, or it could be formed of a greater thickness of material. Other variations in structure may also be employed to achieve a result wherein the skirt of the vacuum shroud is stiffened throughout and the roof is reinforced above the grinding disk while the periphery of the roof remains resilient and flexible. Accordingly, the scope of the invention should not be construed as limited to the specific embodiments depicted in the drawings and described herein.

I claim:

1. A vacuum shroud for a grinding tool having a grinder body, a rotary drive shaft protruding from said grinder body and a grinding disk attached to said grinder body comprising: a concave, hood formed with a laterally extending roof defining a periphery and having a central axial opening therethrough for receiving said rotary drive shaft and a skirt extending from said periphery of said roof and disposed about said grinding disk beyond the perimeter thereof and wherein said skirt is stiffened by a rigid metal band secured thereto and in contact therewith throughout an interface located radially beyond said grinding disk and below said roof and the periphery of said roof is resilient and flexible.

2. A vacuum shroud according to claim 1 wherein said roof has an underside and said roof and said skirt are formed as a unitary, resilient, flexible, plastic bonnet and said hood is further comprised of a rigid plate secured against said underside of said roof in overlying relationship to said grinding disk to thereby provide reinforcement from beneath to the portion of said roof above said grinding disk.

3. A vacuum shroud according to claim 2 wherein said skirt has an annular shape and said rigid metal band is formed as a reinforcing metal ring encapsulated within the structure of said skirt.

4. A vacuum shroud according to claim 2 wherein said rigid plate has a flat interior portion with a central opening therethrough that is coaxial with said central, axial opening in said roof, and a plurality of flanges extending radially from said flat interior portion.

5. A vacuum shroud for a grinder comprising: a resilient bonnet formed with a central, axial opening therein for receiving a rotary grinder shaft therethrough, wherein said bonnet is formed with a roof having an undersurface and which has a vacuum port therein and which extends radially from said central axial opening, and a peripheral skirt that extends from said roof toward a work surface radially beyond a grinder disk attached to said rotary shaft, and a peripheral metal reinforcement strip secured to said skirt and located radially beyond said grinder disk and in contact with said skirt throughout an interface therebetween located radially beyond said grinder disk and below said undersurface of said roof to limit flexure of said skirt.

6. A vacuum shroud according to claim 5 wherein said bonnet is formed as a concave plastic dish-shaped structure from which a segment is removed.

7. A vacuum shroud according to claim 5 wherein said bonnet is formed as a unitary, molded plastic, concave, dish-shaped structure in which said skirt has an annular configuration, and said reinforcement strip is formed of a metal band.

8. A vacuum shroud according to claim 7 wherein said metal band is encapsulated within the structure of said skirt.

9. A vacuum shroud according to claim 5 further comprising a rigid reinforcement plate disposed against said undersurface of said roof to thereby provide protection to said roof above said grinder disk, wherein said rigid reinforcement plate is formed in an annular configuration having a flat, radially interior region from which a plurality of flanges extend radially outwardly.

10. A vacuum shroud according to claim 9 wherein said reinforcement plate is formed as a stamped, aluminum member.

11. In a grinding tool having a grinder body, a rotary drive shaft protruding from said grinder body, a grinding disk attached to said rotary drive shaft and a vacuum shroud including a concave bonnet disposed about said rotary drive shaft and said grinding disk, wherein said bonnet has a roof with a vacuum port defmed therethrough and is secured relative to said grinder body and extends radially outwardly relative to said rotary drive shaft past the perimeter of said grinding disk in overlying relationship relative to said grinder disk, and said bonnet has a skirt extending from the periphery of said roof in a disposition about said grinding disk beyond the perimeter thereof, the improvement wherein said skirt of said bonnet is stiffened by a rigid, stiffening band secured thereto and in contact therewith throughout an interface therebetween located beyond said perimeter of said grinding disk and below said roof and said roof of said bonnet has a resilient and flexible peripheral portion.

12. A grinding tool according to claim 11 wherein said bonnet is formed by a flexible and resilient, molded plastic, bowl-shaped member having a concave undersurface facing said grinding disk, and the interior portion of said roof overlying said grinding disk is reenforced and said vacuum shroud is formed of a rigid reinforcement plate residing in contact with said undersurface of said bonnet and in overlying relationship relative to said grinder body by fasteners that extend through said roof.

13. A grinding tool according to claim 12 wherein said rigid band is encapsulated within said skirt.

14. A grinding tool according to claim 11 wherein said bonnet is formed with a concave undersurface from a flexible and resilient, molded plastic structure which has an otherwise bowl-shaped configuration with a segmental portion removed therefrom, and said rigid, band has an arcuate shape and said roof has an interior portion overlying said grinding disk, and further comprising a rigid reinforcement plate disposed in contact with said concave undersurface against said interior portion of said roof.

15. A grinding tool according to claim 14 wherein said rigid, arcuate band is encapsulated within the structure of said skirt.

* * * * *